US005781111A

United States Patent [19]

Easter et al.

[11] Patent Number: 5,781,111

[45] Date of Patent: Jul. 14, 1998

[54] APPARATUS FOR DEACTIVATION OF ELECTRONIC ARTICLE SURVEILLANCE TAGS

[75] Inventors: Ronald B. Easter, Parkland; Steven W. Embling, Pompano Beach, both of Fla.

[73] Assignee: Sensormatic Electronics Corporation, Boca Raton, Fla.

[21] Appl. No.: 721,125

[22] Filed: Sep. 26, 1996

[51] Int. Cl.[6] ..... G08B 13/14

[52] U.S. Cl. ..... 340/572; 340/551; 361/149; 361/155; 361/156

[58] Field of Search ..... 340/572, 551, 340/825.63; 361/151, 149, 153, 156, 155, 267

[56] References Cited

U.S. PATENT DOCUMENTS

| | | | |
|---|---|---|---|
| 3,832,530 | 8/1974 | Reitboeck et al. | 340/572 |
| 4,218,722 | 8/1980 | Yoshizawa | 361/149 |
| 4,617,603 | 10/1986 | Johnson et al. | 361/149 |
| 4,621,299 | 11/1986 | Hill | 361/151 |
| 5,254,974 | 10/1993 | Rebers et al. | 340/572 |
| 5,257,010 | 10/1993 | Rehder | 340/572 |
| 5,258,766 | 11/1993 | Murdoch | 343/742 |
| 5,341,125 | 8/1994 | Plonsky et al. | 340/572 |
| 5,357,398 | 10/1994 | Kamijoh | 361/267 |
| 5,493,275 | 2/1996 | Easter | 340/572 |
| 5,534,836 | 7/1996 | Schenkel et al. | 335/284 |

*Primary Examiner*—Jeffery A. Hofsass
*Assistant Examiner*—Benjamin C. Lee
*Attorney, Agent, or Firm*—Paul T. Kashimba

[57] ABSTRACT

In accordance with the present invention there is provided an apparatus for deactivating electronic article surveillance tags comprising a deactivation coil, a capacitor, charging means for charging the capacitor to a predetermined level, and an electronic switch connected to the capacitor and the deactivation coil so that when the switch is open the capacitor can be charged by the charging means and when the switch is closed the capacitor can discharge through the deactivation coil.

24 Claims, 6 Drawing Sheets

FIG. 7A
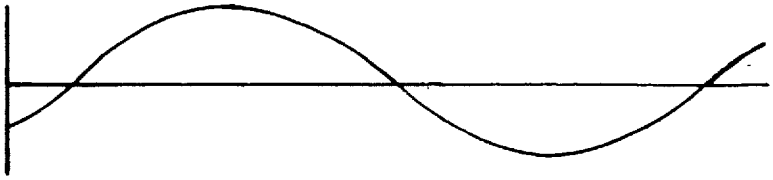
FIG. 7B
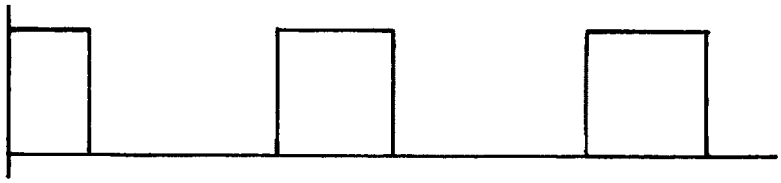
FIG. 7C
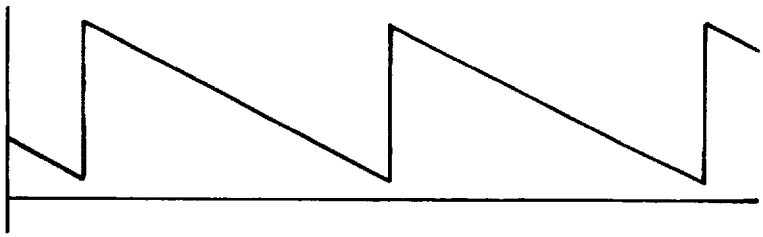
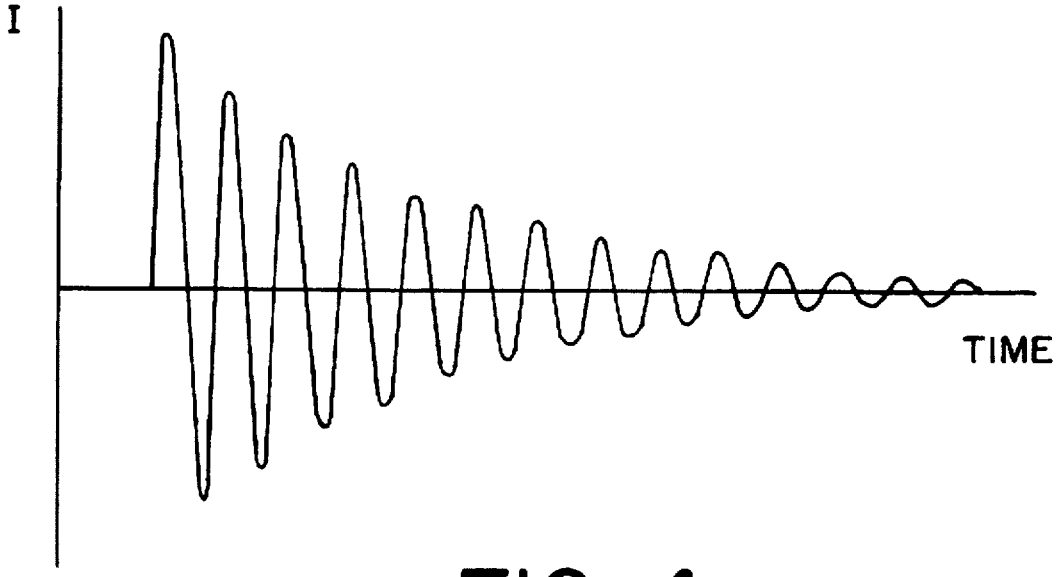
FIG. 4

APPARATUS FOR DEACTIVATION OF ELECTRONIC ARTICLE SURVEILLANCE TAGS

FIELD OF THE INVENTION

This invention relates to electronic article surveillance and, more particularly, to deactivating electronic article surveillance tags.

BACKGROUND OF THE INVENTION

Electronic article surveillance (EAS) systems have employed either reusable EAS tags or disposable EAS tags to monitor articles. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices use coils which are energized to generate a magnetic field of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally parallel to the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk places a bag or bulk container into the cavity and then places the tagged articles into the bag. After all of the articles have been placed into the bag or when the bag is full, the clerk energizes the coils to deactivate all of the EAS tags in the bag. The clerk then lifts the bag out of the cavity. This system provides deactivation of multiple tags at one time and does not require specific orientation of the tags.

The widespread usage of EAS systems has created a demand for systems that provide improved reliability and reduced cost. This is especially true for the deactivation portion of the EAS system including the deactivation coils and power supply for energizing the deactivation coils. Each time the deactivation system is operated, the power supply must reliably provide an accurate waveform of the appropriate power to energize the deactivation coils. Accurately creating the desired field ensures that the EAS tag has been deactivated so that it does not cause an alarm condition when the customer exits the store.

SUMMARY OF THE INVENTION

In accordance with the present invention there is provided an apparatus for deactivating electronic article surveillance tags comprising a deactivation coil, a capacitor, charging means for charging the capacitor to a predetermined level and an electronic switch. The electronic switch is connected to the capacitor and the deactivation coil so that when the switch is open the capacitor can be charged by the charging means and when the switch is closed the capacitor can discharge through the deactivation coil.

The present invention also provides a method of deactivating electronic article surveillance tags comprising charging a capacitor to a predetermined level and connecting the charged capacitor to a deactivation coil so that the capacitor discharges through the deactivation coil.

Accordingly, the present invention provides an improved deactivator for deactivating EAS tags utilizing the natural resonant decay of a precharged capacitor or capacitor bank in series with the deactivation coil. The capacitor bank is charged to the required value which is determined by the peak magnetic field desired, and the discharge is initiated by closing an electronic switch. The magnetic field created has an alternating polarity and a decaying envelope at a particular decay rate. The EAS deactivator of the present invention operates at a high voltage, i.e., approximately 2500 volts, compared to the low voltage operation, i.e., less than 400 volts, of prior art deactivators. In addition, the switching of the power supply of the present invention is synchronized to the power line to reduce the noise generated by the deactivator.

Other objectives, advantages, and applications of the present invention will be made apparent by the following detailed description of the preferred embodiment of the invention.

DESCRIPTION OF THE DRAWINGS

FIG. 4 is a diagram illustrating the waveform of the current through the deactivation coil of the present invention.

FIGS. 7A–7C illustrate the waveforms at several points in the voltage regulation circuit of FIG. 6.

DESCRIPTION OF PREFERRED EMBODIMENTS

Figure 1:
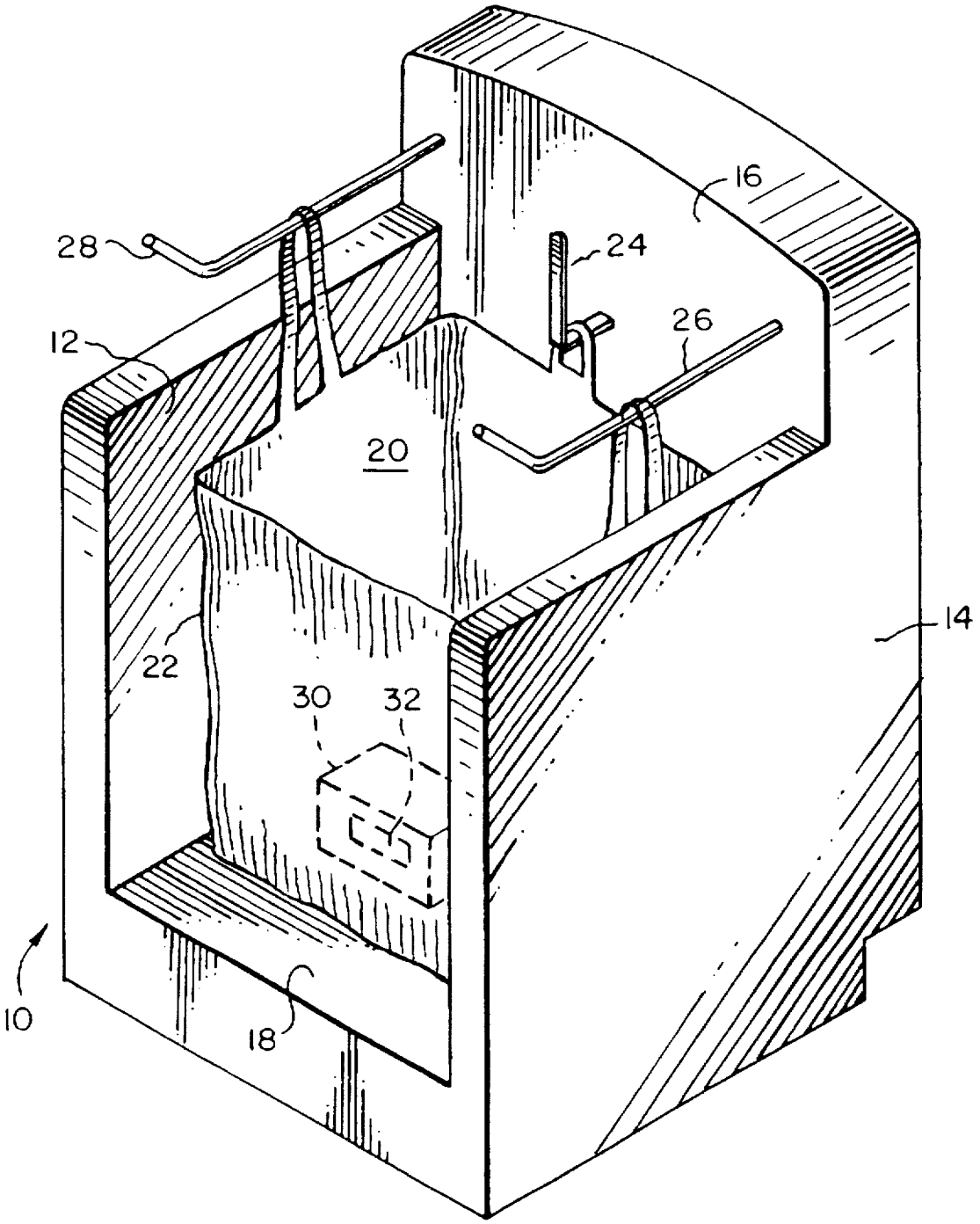
FIG. 1 is a perspective view of a bagging station utilizing the EAS tag deactivation system of the present invention.

Referring to FIG. 1, a bagging station 10 incorporating an EAS deactivation system according to one embodiment of the present invention is shown. Bagging station 10 has three sidewalls 12, 14, and 16 and a bottom 18 that define a volume 20 in which a shopping bag 22 or other bulk container can be placed. A quantity of plastic shopping bags can be placed on bulk holder 24 with their handles on bag racks 26 and 28 and then pulled out for use one at a time. Shopping bag 22 contains article 30 which has an associated EAS tag 32 for use with an EAS system as is known in the art. Preferably EAS tag 32 is a magnetoacoustic EAS tag sold by the assignee of this application under the brand name "ULTRA•MAX®", such EAS tags are used widely for theft deterrence.

Figure 2:
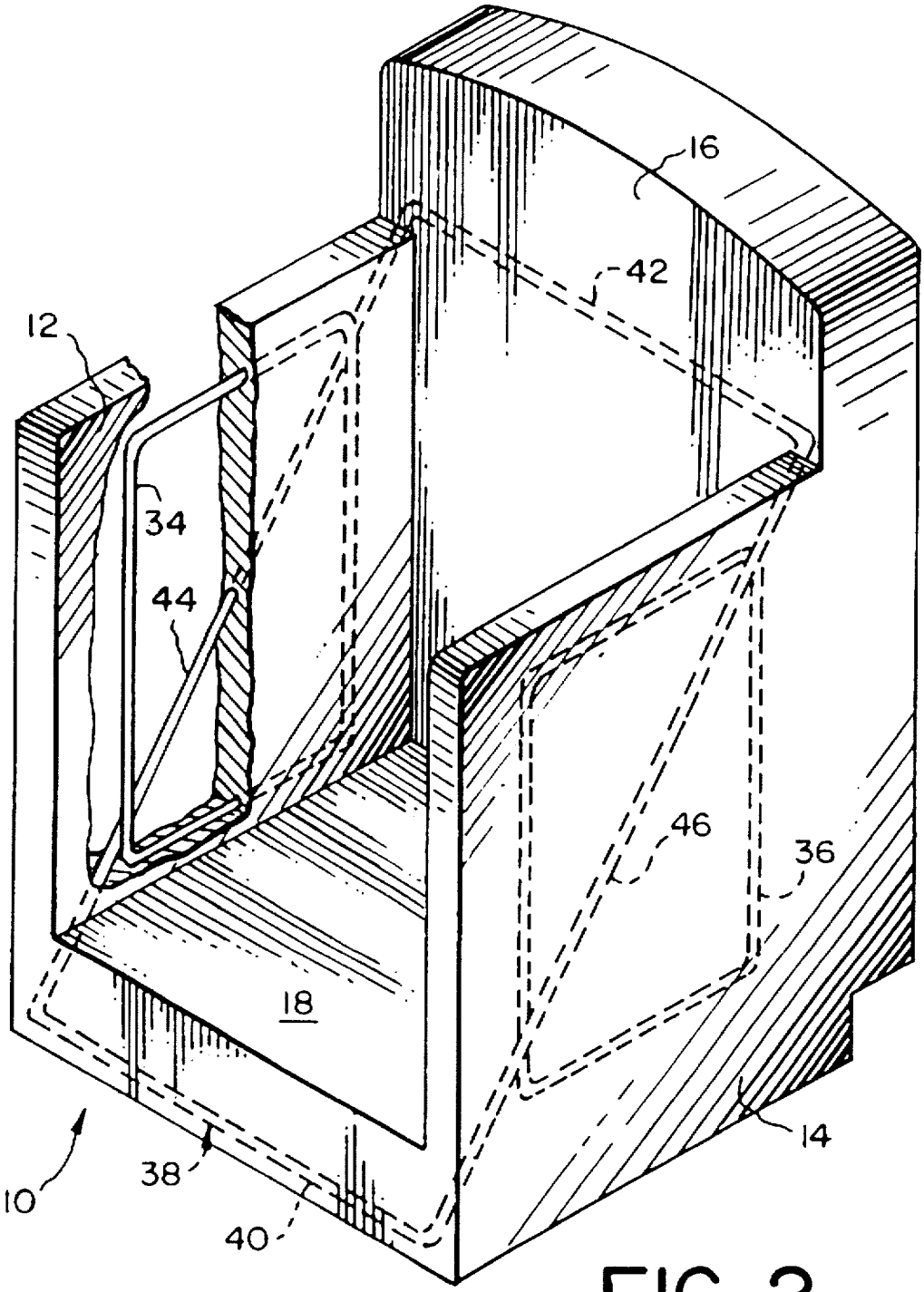
FIG. 2 is a perspective partially cut away view showing one embodiment of the deactivation coils in the bagging station of FIG. 1.

FIG. 2 shows a deactivation coil arrangement of the present invention for use with bagging station 10. Deactivation coil 34 is located inside sidewall 12, and deactivation coil 36 is located inside sidewall 14. Sidewalls 12 and 14 are parallel so that deactivation coils 34 and 36 are located in parallel planes. Deactivation coil 38 has four coil sections 40, 42, 44, and 46. Coil section 40 is located in bottom 18, and coil section 42 is located in sidewall 16. Coil sections 44 and 46 are located in sidewalls 12 and 14 respectively along the approximate respective diagonals of deactivation coils 34 and 36. The power supply connected to deactivation coils 34, 36, and 38 to provide them with the appropriate electrical energy to create the magnetic fields to deactivate EAS tag 32 is discussed in detail below.

Figure 3:
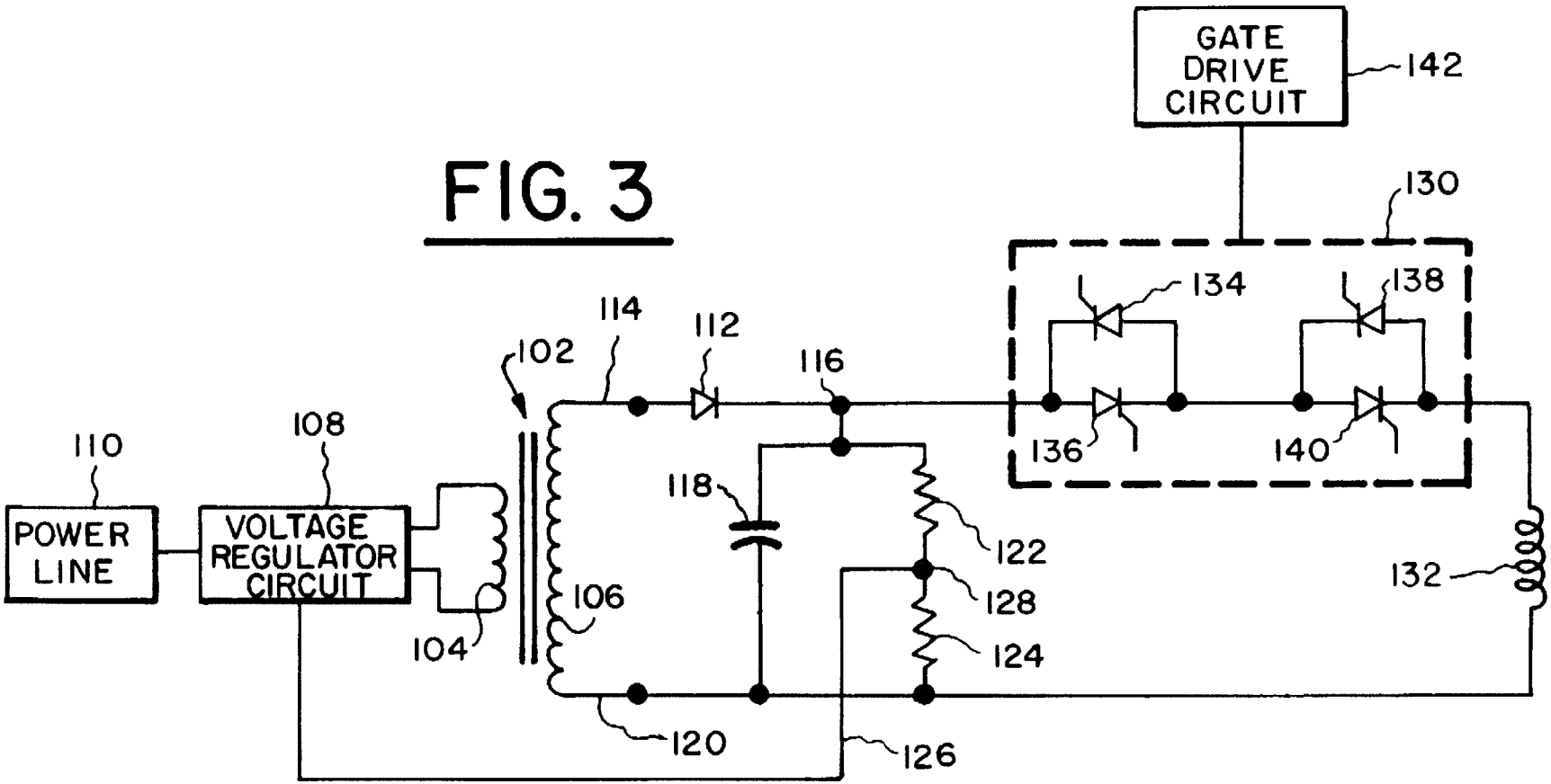
FIG. 3 is a schematic block diagram of the EAS tag deactivation system of the present invention.

Referring to FIG. 3, a preferred embodiment of the deactivation system of the present invention is illustrated. A transformer 102 has a primary winding 104 and secondary winding 106. Primary winding 104 is connected to voltage regulator circuit 108 which in turn is connected to power line 110 which provides an AC power source. The anode of diode 112 is connected to leg 114 of secondary winding 106, and the cathode of diode 112 is connected to node 116. Capacitor 118 is connected across node 116 and leg 120 of secondary winding 106. A voltage divider consisting of resistors 122 and 124 is also connected across node 116 and leg 120. Line 126 connected to node 128 between the series connection of resistors 122 and 124 provides a feedback signal to voltage regulator circuit 108 indicative of the voltage across capacitor 118. Electronic switch 130 in series with deactivation coil 132 is also connected across node 116 and leg 120. Electronic switch 130 comprises silicon controlled rectifiers (SCR's) 134, 136, 138, and 140. SCR's 134 and 136 are connected in antiparallel, SCR's 138 and 140 are connected in antiparallel, and these antiparallel sets are connected in series. The gate drive signals for SCR's 134, 136, 138, and 140 are provided by gate drive circuit 142 which is discussed in detail below with reference to FIG. 5. Gate drive circuit 142 provides simultaneous pulses across the gate and cathode of SCR's 134, 136, 138, and 140.

Deactivation coil 132 is exemplary of deactivation coils 34, 36, and 38 and can be one of the deactivation coils or any number in series. In the embodiment shown, electronic switch 130 has two sets of SCR's connected in antiparallel for illustration. However, depending on the breakdown voltage of the SCR's used and the voltage across capasitor 118, either a single set of SCR's in antiparallel or more than two sets can be used. In addition, electronic switch 130 can have multiple SCR's in each leg if the current required for deactivation coil 132 exceeds the current carrying capacity of the single SCR's. In addition, capacitor 118 is shown as a single capacitor; however, it can comprise a bank of capacitors that are precharged to supply the energy level needed for deactivation coil 132.

FIG. 4 is a waveform illustrating the current through deactivation coil 132 when electronic switch 130 is triggered by gate drive circuit 142. Since the current provided to deactivation coil 132 from capacitor 118 is an alternating current of decreasing magnitude, the resultant deactivation field created by deactivation coil 132 is an alternating decreasing magnetic field.

Figure 5:
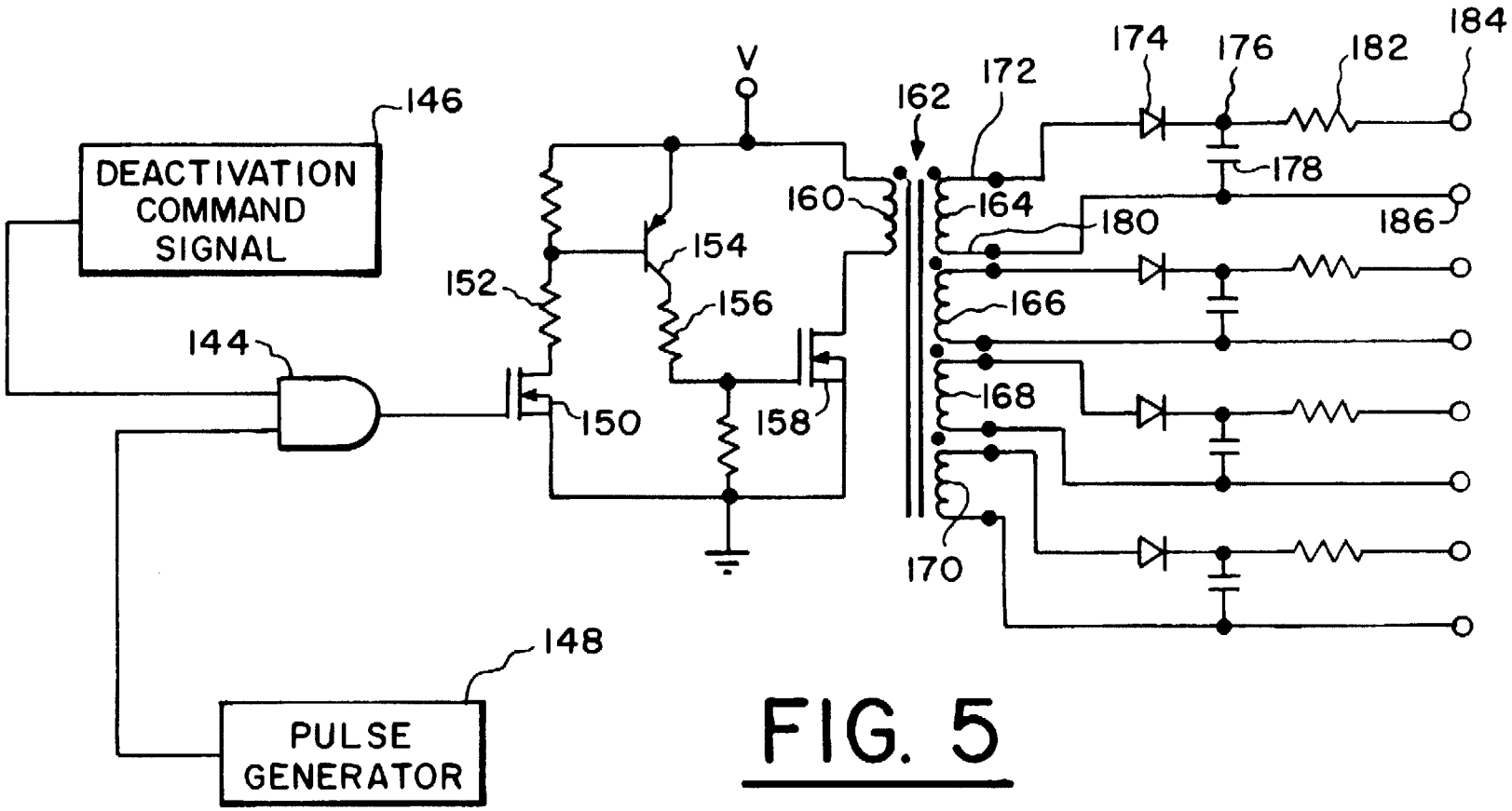
FIG. 5 is a schematic block diagram of one embodiment of the gate drive circuit of the present invention.

Referring to FIG. 5, a schematic block diagram of one embodiment of gate drive circuit 142 is disclosed. AND gate 144 has a first input which receives a deactivation command signal 146 and a second input which is connected to pulse generator 148. Pulse generator 148 provides high frequency pulses at, for example, 70 kilohertz. The output of AND gate 144 is connected to the gate of power MOSFET 150 so that when AND gate 144 receives both a deactivation command signal 146 and a pulse from pulse generator 148 power MOSFET 150 is turned on. The drain of power MOSFET 150 is connected through resistor 152 to the base of transistor 154. When power MOSFET 150 is turned on, transistor 154 is turned on. The collector of 154 transistor is connected through resistor 156 to the gate of power MOSFET 158 so that when transistor 154 is on, power MOSFET 158 is also on. The primary winding 160 of transformer 162 is in series with the drain to source of power MOSFET 158 across circuit power supply V. Accordingly, primary winding 160 is energized when power MOSFET 158 is turned on and is not energized when power MOSFET 158 is turned off.

Transformer 162 has a plurality of identical secondary windings 164, 166, 168, and 170 with identical circuits connected to the respective secondary windings. Using the circuit of secondary winding 164 as an example, leg 172 of secondary winding 164 is connected to the anode of diode 174. The cathode of diode 174 is connected to node 176. Capacitor 178 is connected across node 176 and leg 180 of secondary winding 164. Resistor 182 is also connected to node 176 so that diode 174, capacitor 178, and resistor 182 provide a filtered half wave rectified signal to terminals 184 and 186. Terminals 184 and 186 are connected to the gate and cathode of one of the SCR's in FIG. 3 to provide the appropriate triggering pulses. In like fashion each of secondary windings 166, 168, and 170 have identical circuit configurations and are connected to a respective one of the SCR's in FIG. 3 so that each SCR receives a simultaneous isolated triggering pulse.

Figure 6:
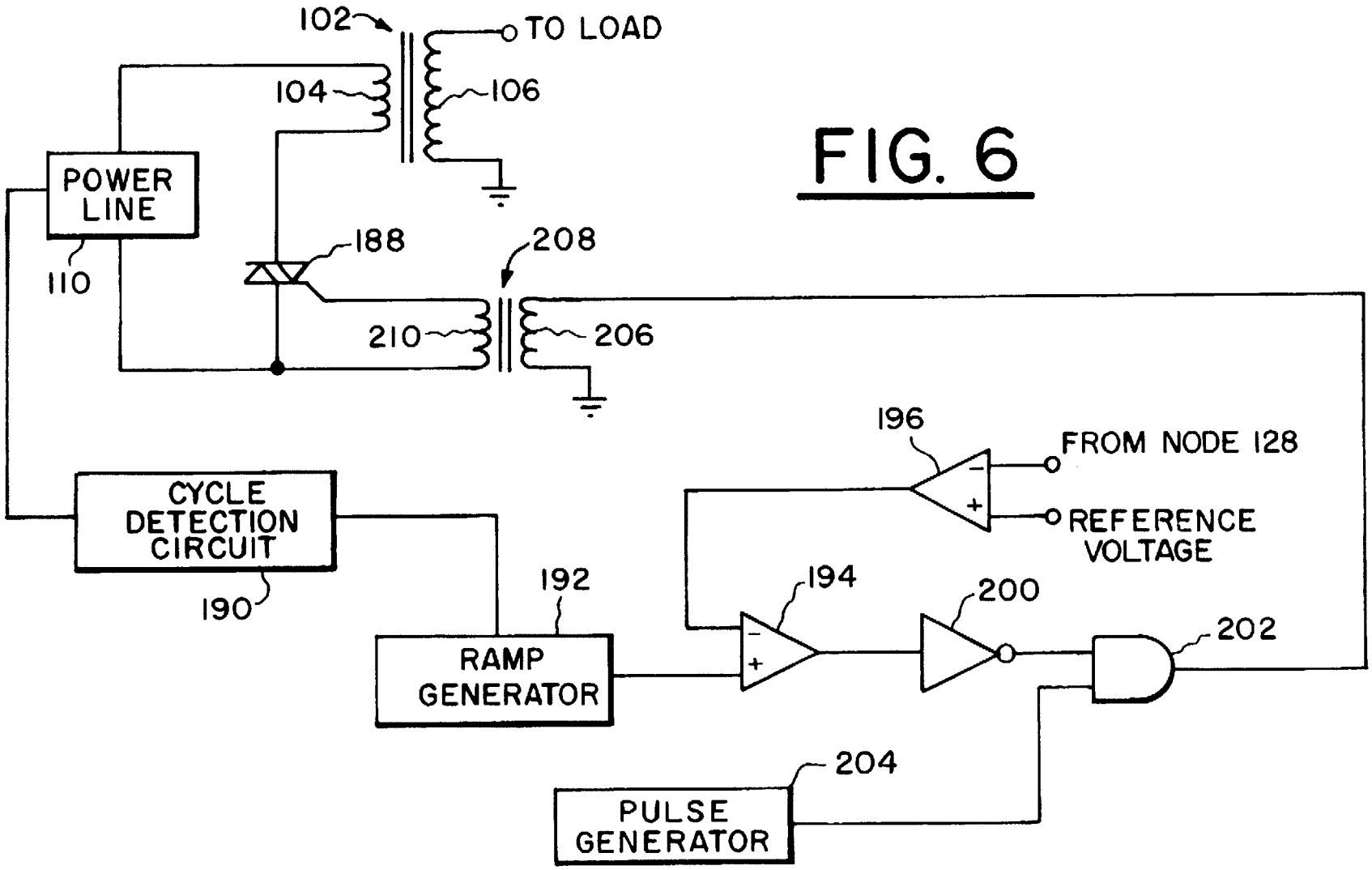
FIG. 6 is a schematic block diagram of one embodiment of the voltage regulation circuit of the present invention.

One embodiment of a power line synchronized modulator of voltage regulator circuit 108 of FIG. 3 is illustrated in FIG. 6. Transformer 102 has secondary winding 106 connected to the load as illustrated in FIG. 3. One leg of primary winding 104 is connected to one side of power line 110, and the other is connected through the first and second anodes of triac 188 to the other side of power line 110. Cycle detection circuit 190 is connected to power line 110 to detect the beginning and ending of each half cycle of the power line signal. Cycle detection circuit 190 provides a reset signal to ramp generator 192 so that ramp generator 192 provides a declining ramp signal that starts at the beginning of each half cycle of the power line signal and terminates at the end of each half cycle of the power line signal. The output of ramp generator 192 is provided to one input of comparator 194. The feedback voltage from node 128 of FIG. 3 which is indicative of the voltage across capacitor 118 is provided to one input of operational amplifier 196. A predetermined reference voltage is provided to the other input of operational amplifier 196 such that when the voltage at node 128 is less than the predetermined reference voltage operational amplifier 196 provides a signal to the other input of comparator 194. When the falling ramp voltage generated by ramp generator 192 is equal to the signal provided by operational amplifier 196, comparator 194 switches and provides a signal to inverter 200. The inverted signal is provided to one input of AND gate 202 and the output of pulse generator 204 is provided to the other input of AND gate 202. The output of AND gate 202 is provided to winding 206 of transformer 208 so that the pulse generator 204 is gated through winding 208 to triac 188 to turn on triac 188 to deliver AC power to primary winding 104. The power cycle is terminated naturally as the AC line voltage crosses zero. This cycle repeats at line frequency with the output of transformer 102 being provided to capacitor 118 until capacitor 118 is charged to the predetermined amount.

FIGS. 7–7C provide an illustration of the voltage waveforms at several points in voltage regulator circuit 108. FIG. 7A is the AC line voltage provided by power line 110. FIG. 7B is the gate drive signal for triac 188. FIG. 7C is reference ramp signal provided by ramp generator 192.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An apparatus for deactivating electronic article surveillance tags, said apparatus comprising: a deactivation coil; a capacitor; charging means connected to said capacitor for charging said capacitor; and a first electronic switch connected to said capacitor and said deactivation coil so that when said first electronic switch is open said deactivation coil is disconnected from said capacitor so that said capacitor can be charged by said charging means without any current flowing through said deactivation coil and when said first electronic switch is closed said deactivation coil is connected to said capacitor so that said capacitor can discharge through said deactivation coil thereby creating an alternating decreasing magnetic field; wherein said charging means comprises synchronizing means for synchronizing the operation of said second electronic switch with the beginning and ending of each half cycle of a charging power line signal.

2. An apparatus as recited in claim 1, wherein said first electronic switch comprises a silicon controlled rectifier.

3. An apparatus as recited in claim 1, wherein said first electronic switch comprises two silicon controlled rectifiers connected in antiparallel.

4. An apparatus as recited in claim 1, wherein said first electronic switch comprises a first set of two silicon controlled rectifiers connected in antiparallel and a second set of two silicon controlled rectifiers connected in antiparallel, said first set connected in series with said second set and said apparatus further comprises signal means for providing a simultaneous gating signal to said silicon controlled rectifiers.

5. An apparatus as recited in claim 4, wherein said capacitor comprises a bank of capacitors.

6. An apparatus as recited in claim 4, wherein said signal means comprises: a transformer having a plurality of secondary windings; a rectifier and filter connected to each of said plurality of secondary windings; and an electronic switch connected to the primary winding of said transformer to control energizing of said plurality of secondary windings.

7. An apparatus as recited in claim 6, wherein said signal means further comprises a pulse generator and a logic device for providing an actuation signal to said electronic switch in said signal means when said logic device receives a signal to deactivate said deactivation coil and a pulse signal simultaneously.

8. An apparatus as recited in claim 1, wherein said charging means further comprises monitoring means for monitoring the voltage across said capacitor and said charging means charges said capacitor to a predetermined voltage.

9. An apparatus as recited in claim 8, wherein said charging means comprises a transformer having a secondary winding connected to said capacitor and a primary winding connected to a power line through a second electronic switch and said charging means provides an actuation signal to said second electronic switch to charge said capacitor when said monitoring means detects that the voltage across said capacitor is less than said predetermined voltage.

10. An apparatus as recited in claim 9, wherein said synchronizing means comprises a reference ramp generator that generates a ramp signal that starts at the beginning of each half cycle of the power line signal and terminates at the end of each half cycle of the power line signal and said charging means provides said actuation to said second electronic switch in response to said ramp signal and the voltage detected by said monitoring means.

11. An apparatus as recited in claim 10, wherein said first electronic switch comprises a first set of two silicon controlled rectifiers connected in antiparallel and a second set of two silicon controlled rectifiers connected in antiparallel, said first set connected in series with said second set and said apparatus further comprises signal means for providing a simultaneous gating signal to said silicon controlled rectifiers.

12. An apparatus as recited in claim 10, wherein said second electronic switch comprises a triac.

13. An apparatus as recited in claim 12, wherein said ramp signal is a decreasing ramp signal.

14. A method of deactivating electronic article surveillance tags, said method comprising the steps of: charging a capacitor; and connect ing the charged capacitor to a deactivation coil so that the capacitor discharges through the deactivation coil to create an alternating decreasing magnetic field, said charging step being performed such that no current flows through the deactivation coil when the capacitor is being charged; wherein said charging step comprises synchronizing the charging of the capacitor with a charging power line signal.

15. A method as recited in claim 14, further comprising the step of monitoring the voltage across the capacitor and wherein said charging step comprises charging the capacitor when said monitoring step detects that the voltage across the capacitor is less than a predetermined voltage.

16. A method as recited in claim 15, wherein said synchronizing step comprises generating a ramp signal that starts at the beginning of each half cycle of the power line signal and terminates at the end of each half cycle of the power line signal and said charging step comprises charging the capacitor in response to the ramp signal from said generating step and the voltage detected by said monitoring step.

17. A method as recited in claim 16, wherein said connecting step comprises providing a simultaneous gating signal to a plurality of electronic switches to connect the charged capacitor to the deactivation coil.

18. A method as recited in claim 14, wherein said connecting step comprises providing a simultaneous gating signal to a plurality of electronic switches to connect the charged capacitor to the deactivation coil.

19. An apparatus for deactivating electronic article surveillance tags, said apparatus comprising:

a deactivation coil;

a capacitor;

charging means for charging said capacitor to a predetermined voltage;

a first electronic switch connected to said capacitor and said deactivation coil so that when said first electronic switch is open said capacitor can be charged by said charging means and when said first electronic switch is closed said capacitor can discharge through said deactivation coil, said charging means comprising monitoring means for monitoring the voltage across said capacitor, a transformer having a secondary winding connected to said capacitor and a primary winding connected to a power line through a second electronic switch and synchronizing means for synchronizing the operation of said second electronic switch with the power line signal, said synchronizing means comprising a reference ramp generator that generates a ramp signal that starts at the beginning of each half cycle of the power line signal and terminates at the end of each half cycle of the power line signal and said charging means provides an actuation signal to said second electronic switch in response to said ramp signal when said monitoring means detects that the voltage across said capacitor is less than said predetermined voltage.

20. An apparatus as recited in claim 19, wherein said second electronic switch comprises a triac.

21. An apparatus as recited in claim 19, wherein said ramp signal is a decreasing ramp signal.

22. An apparatus as recited in claim 19, wherein said first electronic switch comprises a first set of two silicon controlled rectifiers connected in antiparallel and a second set of two silicon controlled rectifiers connected in antiparallel, said first set connected in series with said second set and said apparatus further comprises signal means for providing a simultaneous gating signal to said silicon controlled rectifiers.

23. A method of deactivating electronic article surveillance tags, said method comprising the steps of: charging a capacitor to a predetermined voltage, monitoring the voltage across the capacitor: synchronizing the charging of the capacitor with the power line signal by generating a ramp signal that starts at the beginning of each half cycle of the power line signal and terminates at the end of each half cycle of the power line signal; and connecting the charged capacitor to a deactivation coil so that the capacitor discharges through the deactivation coil, said charging step comprising the steps of charging the capacitor in response to the ramp signal from said synchronizing step when said monitoring step detects that the voltage across the capacitor is less than the predetermined voltage.

24. A method as recited in claim 23, wherein said connecting step comprises providing a simultaneous gating signal to a plurality of electronic switches to connect the charged capacitor to the deactivation coil.

* * * * *

UNITED STATES PATENT AND TRADEMARK OFFICE

CERTIFICATE OF CORRECTION

PATENT NO. : 5,781,111

DATED : July 14, 1998

INVENTOR(S) : Ronald B. Easter and Steven W. Embling

It is certified that error appears in the above-identified patent and that said Letters Patent is hereby corrected as shown below:

Column 3, line 39, change "capasitor" to --capacitor--.
Column 4, line 61, change "7-7C" to --7A-7C--.
Column 6, line 19, change "connect ing" to --connecting--.

Signed and Sealed this

Fifteenth Day of September, 1998

Bruce Lehman

*Attest:*

BRUCE LEHMAN

*Attesting Officer*

*Commissioner of Patents and Trademarks*